United States Patent [19]

Kajino

[11] Patent Number: 4,476,844

[45] Date of Patent: Oct. 16, 1984

[54] METHOD OF AND APPARATUS FOR IGNITING INTERNAL COMBUSTION ENGINE

[76] Inventor: Yukio Kajino, No. 3279-6, Oaza, Yokoze, Yokoze-Mura, Chichibu-Gun, Saitama-ken, 368, Japan

[21] Appl. No.: 419,305

[22] Filed: Sep. 17, 1982

[51] Int. Cl.[3] ..... F02P 1/00; F02P 5/04

[52] U.S. Cl. ..... 123/637; 123/420; 123/146.5 A; 123/607; 200/19 DR; 200/29

[58] Field of Search ..... 123/607, 606, 636, 637, 123/146.5 A, 420; 200/25, 19 DR, 29

[56] References Cited

U.S. PATENT DOCUMENTS

| | | | |
|---|---|---|---|
| 3,502,060 | 3/1970 | Tibbs | 123/607 |
| 4,030,466 | 6/1977 | Lace | 200/19 DR |
| 4,091,787 | 5/1978 | Frank | 123/637 |
| 4,245,594 | 1/1981 | Morino | 123/637 |

FOREIGN PATENT DOCUMENTS

| | | | |
|---|---|---|---|
| 1291353 | 3/1962 | France | 123/637 |

*Primary Examiner*—Ronald B. Cox

*Attorney, Agent, or Firm*—Armstrong, Nikaido, Marmelstein & Kubovcik

[57] ABSTRACT

An electric or electronic system for igniting an internal combustion engine comprising generating electric pulses from a pulse generator at such a desired pulse rate as capable of producing a desired number of electric discharges per one explosion step in each of engine cylinders at the maximum rotational number of an engine crank shaft, stepping-up the voltage of the generated pulses to such a level as enabling electric discharges in a distributor and ignition plugs of the engine cylinders, distributing the thus stepped-up pulses from a feed arm to each of stationary electrodes of the distributor corresponding by the number to that of the cylinders and producing pulse discharges at the desired pulse rate from the ignition plug in each of the cylinders connected to each of the stationary electrodes at the optimum explosion timing to thereby ignite evaporated fuels in the cylinders. An advance control means for the angle of discharge to the stationary electrode adapted to radially displace the feed arm centrifugally due to the rotation of the crank shaft may, desirably, be incorporated to the engine ignition system.

6 Claims, 3 Drawing Figures

METHOD OF AND APPARATUS FOR IGNITING INTERNAL COMBUSTION ENGINE

BACKGROUND OF THE INVENTION

1. Field of the Invention

Figure 1:
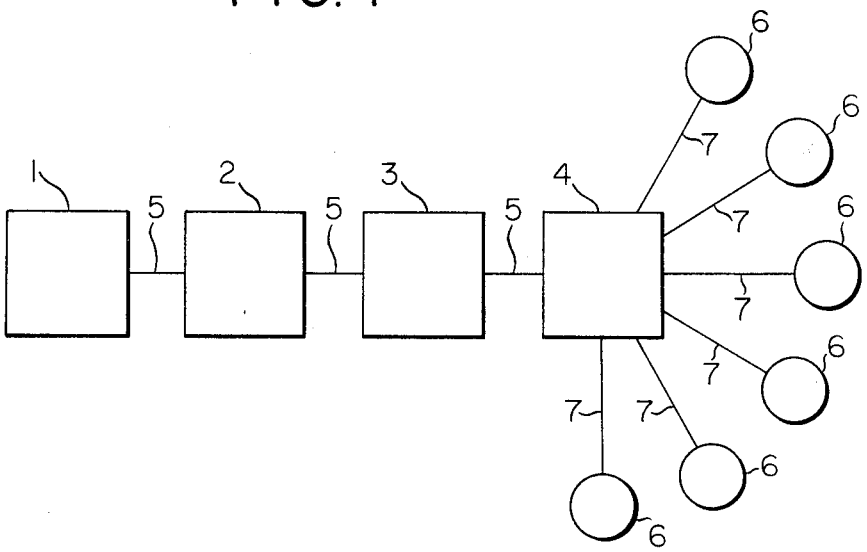

This invention concerns a method of and apparatus for igniting internal combustion engines other than diesel engines.

2. Description of the Prior Art

In internal combustion engines using conventional electric spark ignition systems, engine misfire occurs inevitably, upon igniting evaporated fuels in engine cylinders by way of spark discharges, at a rate as high as 20–30% but it is considered impossible to completely eliminate such undesired phenomena in view of the mechanical structure of the ignition apparatus. Such misfire in engine ignition reduces the engine power below rated levels and produces noxious substances in exhaust gases due to incomplete combustion of fuels as well.

The engine misfire is mainly attributable to the defective operations in the electric system of the ignition apparatus and the reasons or the mechanisms thereof have substantially been recognized. In the conventional engine ignition apparatus, a contact breaker and a distributor interlocking with the rotation of an engine crank shaft are employed as a mechanism for producing electric ignition sparks at a high voltage in engine cylinders in synchronization with the rotation of the crank shaft, wherein electric discharge at high voltage prepared from a DC power source such as a battery or a dynamo generator under the action of a contact point which is turned on and off by the operation of a cam of the contact breaker is distributed by way of a distributor to an ignition plug in each of the engine cylinders to thereby ignite evaporated fuels in the cylinder.

However, the mechanical operations of the contact breaker, distributor and the like can not always correspond smoothly and reliably to the high speed rotation of the engine crank shaft and, therefore, power supply through the route of discharging current at high voltage from an ignition coil to each of the ignition plugs is interrupted occasionally. If the misfire occurs at high frequency during rotation of the engine due to such a reason, it indeed decreases the average power of the engine, although not causing complete stopping of the engine, usually by about 20–30% of the rated power corresponding to the frequency of the misfire.

In view of the foregoing, improvements have been made for the contact breaker or the distributor but no drastic solution can be obtained in the conventional ignition apparatus using mechanical ON-OFF contact actions for the step-up of a low DC voltage source in the ignition coil and, thus, a technique capable of eliminating misfire in engine ignition apparatus has not yet been developed.

Furthermore, in the conventional engine ignition apparatus, evaporated fuel, for example, a mixture of gasoline and air (fed from a carburetor) is compressed to a high pressure in the engine cylinder by the action of a piston or the like, and an electric current at high voltage sent from the contact breaker and distributed by way of the distributor to each of the ignition plugs is discharged only once at the final stage of the compression step, that is, at an optimum explosion timing to thereby ignite and fire the fuel in the cylinder.

However, since the electric spark discharge at the explosion step in the cylinder is produced only once during a brief moment of the compression step of the piston actuated by the high speed rotation of the engine, if an electric spark discharge is produced, it may sometimes result in only incomplete combustion of the fuel.

The ignition or firing phenomena caused by the spark discharge in the engine cylinder will now be considered more specifically. Sparks produced by an electric discharge between a center electrode and a grounded electrode of the ignition plug ignite combustible particles of the gaseous fuel in contact with the sparks and the ignition propagates from the initially ignited particles to each of adjacent combustible particles successively in an extremely brief period of time, that is, explosion occurs. However, since the electric discharge is produced only once per one compression step, not all of the combustible particles are fired at once but only the particles adjacent to the path of the electric spark are ignited initially and then adjacent combustible particles are fired successively. Since the time required for firing all of the combustible particles in the cylinder, although short in itself is relatively long as compared with an extremely high speed of the piston, the subsequent exhaustion step may sometimes start before all of the combustible particles are fired in the explosion step. This leads to incomplete combustion of fuels and, therefore, produces undesired noxious substances in the exhaust gases.

At present, a strict legal regulation is imposed on the discharge level of such noxious substances contained in the engine exhaust gases and various coutermeasures have been taken for meeting the standard. However, most of them concern the provision of catalytic converters for the after-treatment of the exhaust gases or the recycling of the exhaust gases to the engine cylinder and no effective means have yet been developed for the improvement of the disadvantages of the engine ignition apparatus which are responsible for one of the major factors of incomplete combustion.

As described above, although conventional ignition apparatus for the internal combustion engines involve inherent drawbacks lacking in the smooth and reliable ignition for the engine, such drawbacks have been considered inevitable to some extent and no effective technical ideas for overcoming them have yet been proposed.

SUMMARY OF THE INVENTION

Accordingly, it is an object of this invention to provide a method of igniting an internal combustion engine capable of igniting the engine smoothly and reliably by way of electronic or electric means with no risk of misfire due to the defective operations in mechanical systems and thereby improving the engine power and decreasing the level of noxious substances in the engine exhaust gases.

Another object of this invention is to provide a novel apparatus for igniting an internal combustion engine in an electronic or electric structure suitable to the practice of the method of igniting the internal combustion engine as described above.

A further object of this invention is to provide an advance control means which may suitably be incorporated with the method of and apparatus for igniting the internal combustion engine as described above.

The first object can be attained by a method of igniting an internal combustion engine according to this invention comprising a step of generating a train of pulses from a pulse generator adapted to generate pulses at such a desired pulse rate as capable of producing a desired number of electric discharges per one explosion step in each of engine cylinders at the maximum number of rotations of an engine crank shaft, a step of stepping-up the voltage of the pulses thus generated so that electric discharges can be produced in a distributor and in ignition plugs of the engine cylinders, a step of distributing electric supply for producing electric discharge of pulses at the desired pulse rate from a feed arm fixed to a rotor means rotating interlocking with the crank shaft of the engine to one of stationary electrodes of the distributor when the feed arm and one of the stationary electrodes are opposed to each other, and a step of carrying out electric discharge of pulses at the desired pulse rate in each of the ignition plugs connected to each of the stationary electrodes respectively at the optimum explosion timing when evaporated fuels in each of the cylinders are compressed to the highest pressure.

Another object can be obtained by an apparatus for igniting an internal combustion engine according to this invention comprising a power source, a pulse generator connected to the power source for generating a train of pulses at such a desired pulse rate as capable of producing a desired member of electric discharges per one explosion step in each of engine cylinders at the maximum number of rotations of an engine crank shaft, a pulse transformer for stepping-up the voltage of the pulses so as to enable electric discharges of the pulses in a distributor and in ignition plugs, a distributor having an insulation tube securely disposed radially to a rotor means interlocked with the rotation of the engine, a feed arm disposed in the insulation tube with the discharging top end of the arm being situated at the inner side from the radially outermost end of the insulation tube and the base end of the arm being connected to the secondary windings of the pulse transformer and a plurality of stationary electrodes disposed by the number corresponding to that of the cylinders of the engine and arranged circumferentially at an equi-pitch spaced apart from each other by an insulating section along an outer circle concentric with a circle traced by the rotation of the insulation tube, and ignition plugs each disposed in each of the cylinders and connected to each of the stationary electrodes of the distributor, and wherein electric discharges of pulses are produced from the ignition plug in each of said cylinders by the number corresponding to the pulse rate of the pulses generated from the pulse generator at the optimum explosion timing when the evaporated fuels in each of the cylinders are compressed to the highest pressure.

A further object can be attained by the method of igniting an internal combustion engine according to this invention, wherein the angle of the electric discharge from the feed arm to the opposing stationary electrode is varied by displacing the feed arm in the radial direction of rotation in accordance with a centrifugal force caused by the rotation of the rotor means to the feed arm in the step of distributing the electric supply, to thereby perform advance control for the ignition.

BRIEF DESCRIPTION OF THE ACCOMPANYING DRAWINGS

Figure 2:
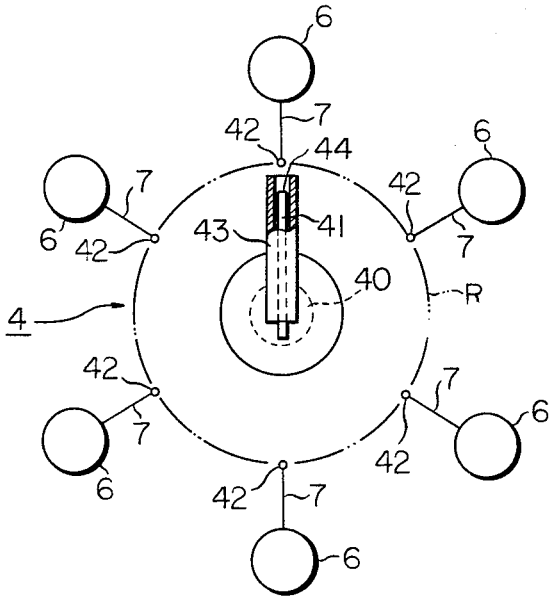
Figure 3:
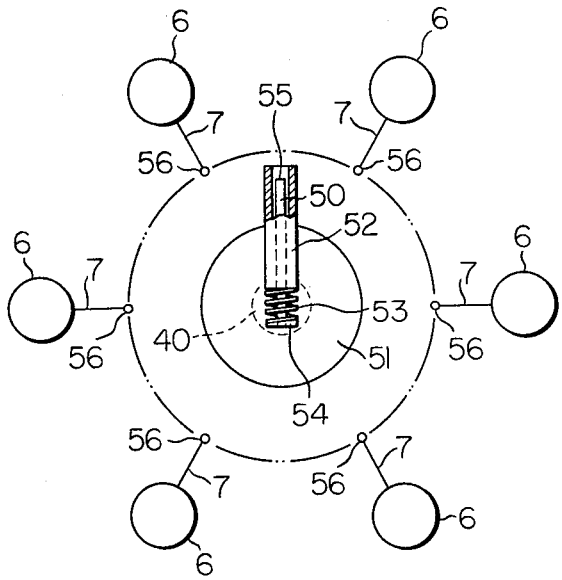

These and other objects, as well as advantageous features of this invention will become clearer by the description of preferred embodiments referring to the accompanying drawings, wherein FIG. 1 is a block diagram for the electric system of an engine ignition apparatus according to this invention, FIG. 2 is an explanatory view for one embodiment of a distributor for use with the apparatus shown in FIG. 1, and FIG. 3 is an explanatory view for a modified embodiment of a distributor in which an advance control device is attached to the distributor shown in FIG. 3.

DESCRIPTION FOR PREFERRED EMBODIMENT

As schematically shown in FIG. 1, one embodiment of an electric spark type engine ignition apparatus according to this invention comprises a power source 1, for example, of a battery or a dynamo generator, a pulse generator 2, a pulse transformer 3 and a distributor 4 connected successively each by way of a conductor 5, as well as a plurality of ignition plugs 6 corresponding by the number to that of engine cylinders and connected to the distributor 4 each by way of a conductor 7. The pulse generator 2 connected to the power source 1 is designed to generate a train of pulses at a predetermined pulse rate or number of pulses per second. The pulse current thus generated is stepped-up to a high voltage in the transformer 3, distributed to each of the ignition plugs 6 and then discharged between a center electrode and a grounded electrode in each of the ignition plugs 6 to fire a mixture of air and fuel, e.g., gasoline fed from a carburetor (not shown) and compressed in each of the cylinders.

The distributor 4 comprises an insulation tube 43 (or equivalent member) which is made of ceramic or the like and composed of one or a plurality of tubular members depending on the mode of engine operation cycle and secured radially to a rotor or rotational shaft 40 driven by an engine cam shaft (not shown). A current feed arm 41 (or equivalent member) is disposed within the insulation tube 43 so that the discharge top end 44 of the feed arm 41 is located inside (that is, retracted within) the outermost radial end of the insulation tube 43 and stationary electrodes 42 corresponding in number to that of the engine cylinders (six cylinders being disposed in the illustrated embodiment) circumferentially disposed equiangularly (that is, at equally spaced intervals) separated from each other by an insulation section on an outer circle R coaxial with the circle traced by the rotation of the insulation tube 43. The base end of the feed arm 41 on the distributor 4 is connected by way of the conductor 5 to the secondary windings of the pulse transformer 3 and each of the stationary electrodes 42 is connected to the ignition plug 6 in each of the corresponding engine cylinders by way of a conductor 7.

Thus, electrical discharge is produced at first from the discharge top end 44 of the feed arm 41 axially disposed within the insulation tube 43 to each of the stationary electrodes 42 disposed along the axial extension of the insulation tube 43, whereby the pulse current for the electrical discharge is distributed from the distributor 4 to each of the ignition plugs 6 disposed in each of the engine cylinders.

As shown in FIG. 2, each of the stationary electrodes 42 is arranged with a slight gap to the discharge top end 44 of the feed arm 41 axially disposed within the insulation tube 43 along the axial extension thereof, so that electric discharge is carried out between the discharge top end 44 and the corresponding stationary electrode 42 and then in the ignition plug 6 connected to the stationary electrode 42 and disposed in each of the engine cylinders.

FIG. 3 shows a modified embodiment of this invention in which an advance control device or a timing control device for the ignition is incorporated to the basic structure of the distributor as shown in FIG. 2.

The distributor shown in FIG. 3, has a movable feed arm 50 disposed axially movably within an insulation tube 52, instead of the feed arm 41 fixedly disposed within the insulation tube 43 on the distributor shown in FIG. 2.

Also in this embodiment, the insulation tube 52 is composed of one or plurality of tubular members made of the same material as that of the insulation tube 43 of the distributor shown in FIG. 2 and secured radially to a part of a rotor 51 mounted at the top end of a rotational shaft 40 interlocking with the rotation of an engine crank shaft (not shown). It is to be noted in this embodiment that the movable feed arm 50 is disposed within the insulation tube 52 so that the arm can be moved in the axial direction of the insulation tube 52 i.e., in the radial direction of rotation, with the base end of the arm 50 being electrically connected by way of the conductor 5 to the secondary windings of the pulse transformer 3 shown in FIG. 1. The base end of the movable feed arm 50 is resiliently biased axially by a coil spring 53 having a predetermined spring coefficient mounted between a stopper 54 formed at the base end of the feed arm 50 and the innermost radial end of the insulation tube 52. The advance control device is assembled by abutting one end of the coil spring 53 against the innermost end of the insulation tube 52 while aligning their axial centers and then inserting the movable feed arm 50 from its discharge top end 55 through the coil spring 53 and then into the insulation tube 52. In the state where the coil spring 53 is set free with no axial compressive force, the discharge top end 55 of the movable feed arm 50 is retracted somewhat from the outermost radial end of the insulation tube 52. In this case, electric discharges from the discharge top end 55 of the movable feed arm 50 to the corresponding stationary electrode 56 takes place substantially along the axial extension of the insulation tube 52, that is, the angle of discharge is narrow. While on the otherhand, as the engine speed increases, the movable feed arm 50 automatically advances within the insulation tube 52 axially toward the outermost radial end thereof against the spring force of the coil spring 53 by the centrifugal force exerted to the movable feed arm 50 caused by the increasing rotational speed of the engine. In this case, since the discharge top end 55 is substantially coplanar with the outermost radial end of the insulation tube 52, the electric discharge route between the discharge top end 55 and the stationary electrode 56 can be advanced relative to the axial extension of the insulation tube, that is, the angle of discharge is widened. The stopper 54, which is provided at the base end of the movable feed arm 50, serves to prevent the feed arm 50 from disengaging out of the device both in the retracted and advanced positions.

The pulse current thus distributed from the movable feed arm 50 to each of the stationary electrodes 56 by the electric discharge through the slight spark gap therebetween is then transmitted to the ignition plug 6 in each of the corresponding engine cylinders, where electric discharges by the pulse current are repeated a desired number of times corresponding to the pulse rate in one explosion step of the engine cylinder to fire the compressed air-fuel mixture by electric sparks, for instance, between the center electrode and the grounded electrode (not shown) of the ignition plug 6.

The operation of the engine ignition apparatus according to this invention is to be described more in detail.

The number or frequency of electric discharges per one explosion step in a cylinder is explained first.

Assuming the number of rotations per minute (r.p.m.) of the crank shaft for a six cylinder type engine as 750 for the idling rotation and as 7,000 for the maximum speed rotation, the number of explosion steps occuring per second in the idling can be approximated as:

$$\frac{750 \times 3}{60 \text{ sec}} = 37.5 \text{ (explosion)/sec}$$

and the number of explosion steps occuring per second in the maximum speed rotation can be approximated as:

$$\frac{7000 \times 3}{60 \text{ sec}} = 350 \text{ (explosion)/sec}$$

As previously described, one of the features of this invention is to ensure a plurality of electric discharges for the ignition plug in a cylinder during one explosion step, while electric discharge has hitherto been effected only once during one explosion step in the cylinder in the prior system.

As apparent from the foregoing, the number of explosions in the cylinder of the electric spark ignition type engine is increased along with the increase in the engine rotation speed from the idling state to the maximum rotation state. Then, a brief consideration will be made of the pulse rate, that is, the number of pulses per second required for attaining a plurality of electric discharges per one explosion step which is one of the basic features of this invention.

Since a six cylinder type engine repeats explosion steps at 350 cycle/sec as the whole during the maximum rotation of 7,000 r.p.m., if the desired number of electric discharges per one explosion step in one cylinder is 10 times/explosion (one cylinder), it requires 3,500 ($=350\times10$) times/sec of electric discharge for the entire engine. Then, if 3,500 times/sec of total electric discharges are given based on the maximum engine rotation, it will ensure about 93.3 ($10\times350/37.5$) times/sec of electric discharges per one explosion step in one cylinder for the idling rotation. In this way, the discharge times/sec per one explosion step is increased from the maximum rotation to the idling rotation in inverse proportion to the number of engine rotations. As will be apparent, 10 times of electric discharge per one explosion step in one cylinder determined on the basis of the maximum rotation require a pulse current at 3,500 pulse rate, i.e., 3.5 KHz of pulses per second. The pulses at 3.5 KHz are of course sufficent for causing a desired number of electric discharges also in the idling rotation, and thus the pulse rate may be fixed throughout the varying range of the engine rotation speed. However, the pulse rate may, alternatively, be variable depending on the engine rotation speed and it will be obvious to those skilled in the art to design the pulse generator 2 in FIG. 1 such that it produces a pulse train whose pulse rate is variable, for example, at a certain coefficient in inverse proportion to the number of rotations of the engine which can be detected, for example, by an adequate speed sensor.

Then explanation is to be made for the engine ignition operation in the illustrated embodiment in which a plurality of electric discharges are repeated per one explosion step in one engine cylinder.

A pulse train generated from the pulse generator 2 at a desired pulse rate determined as above is stepped-up through the pulse transformer 3 to a desired high voltage, enough to produce electric discharges in the distributor 4 and in each of the plugs 6, and supplied to the distributor 4 at the base end of the feed arm secured thereon. Then, in the embodiment shown in FIG. 3 (the fundamental operation is the same also in the basic embodiment shown in FIG. 2), the high voltage pulse current is distributed from the distributor 4 to each of the ignition plugs 6 as described below. With the rotation of the insulation tube 52 radially secured to the rotor 51 interlocked with the rotation of the engine crank shaft, the discharge top end 55 of the movable feed arm 50 movably disposed within the tube 52 rotates along a row of the stationary electrodes 56 disposed circumferentially. On every instance the discharge top end 55 opposes to one of the stationary electrodes 56, pulse current discharge occurs through the gap between them and the pulse current thus distributed to each of the stationary electrodes 56 is successively transmitted through the conductor 7 to the ignition plug 6 in each of the cylinders.

Evaporated fuel fed from the carburetor to the cylinder, whose ignition plug 6 has just received the distributed pulse current, is now compressed to the highest pressure by a piston interlocked with the crank shaft and, at this optimum explosion timing, pulse current discharge occurs in the ignition plug to fire the compressed gaseous fuel. The spark discharge occurs by the desired number corresponding to the pulse rate between the center electrode and the grounded electrode of the ignition plug to thereby cause explosion of the gaseous fuel in the cylinder.

Explanation is to be made for the function of the centrifugal type advancer or timing control device of the distributor 4. Where the engine is rotated at a relatively high speed, the movable feed arm 50 is axially moved against the resiliency of the coil spring 53 through the insulation tube 52 rotated integrally with the rotor 51 interlocked with the crank shaft by the centrifugal force exerted in proportion to the rotational speed and the discharge top end 55 arrives at a position near the outermost radial end of the insulation tube 52. Since the discharge top end 55 becomes substantially coplanar with the outermost end of the tube 52, the pulse discharge route toward the stationary electrode 56 is widened with respect to the axial extension of the insulation tube 52 and, thus, the electric discharge between the discharge top end 55 and the opposing stationary electrode 56 is initiated at the moment just before both of them are opposed exactly along the axial extension and then continues for a short period after they are displaced from each other. Thus, the advance control is carried out centrifugally to increase the angle of discharge in proportion to the increase of the engine rotation speed thereby ensure reliable distribution for the discharge pulse even in the high speed rotation state.

Now, the mechanisms and the advantages for the fuel ignition attained by a plurality of pulse discharges per one explosion step will be explained specifically. At first, the explosion mechanisms observed in the prior art ignition system are briefly explained for reference. In the conventional engine ignition system, electric discharge is produced only once from the center electrode to the grounded electrode of the ignition plug at the moment when the gaseous fuel fed to the relevant engine cylinder is compressed to the highest pressure. In this case, only the combustible particles of the fuel in direct contact with the discharge sparks are ignited at first and the ignition is propagated successively from the ignited particles to their adjacent combustible particles, till all of the combustible particles of the compressed gaseous fuel in the cylinder are fired to cause rapid expansion in a brief instance, that is, explosion. However, since the fire propagation starts from the combustible particles ignited by spark discharge only for once in the prior system, it takes a relatively longer time from the start of the ignition to the completion of the fire propagation throughout the entire gaseous fuel, although brief in itself, as compared with an extremely rapid speed of the piston movement. Accordingly, it may sometimes occur that the explosion step proceeds to the subsequent exhaustion step before the ignition is propagated through all of the fed combustible particles, which leads to the generation of exhaust gases containing unburnt and thus toxious substances.

On the other hand, in the ignition system according to this invention, a plurality of spark discharges are repeated at one explosion step by using electric discharge pulses at a desired pulse rate to thereby increase the number of combustible particles initially ignited in contact with the discharge sparks, so to speak ignition "seeds", from which the fire is propagated to other portions of combustible particles. Accordingly, if the number of such ignition seeds is increased by the increase in the number of electric discharges, that is, pulse rate, the ignition speed throughout the entire fuel in the engine cylinder is increased to enhance the explosion force and, therefore, improve the engine power as compared with the prior ignition system, in which the same kind of fuel is employed in the same amount.

In this way, ignition propagates extremely rapidly through out the combustible particles and all of the gaseous fuels in the cylinder are burnt completely in a brief moment of the explosion step before the subsequent exhaustion step starts. Thus, complete combustion of the fuel is ensured in this embodiment, which leads to the substantial reduction of noxious substances in exhaust gases that have hitherto been produced considerably in the prior ignition system due to incomplete combustion of the fuel.

In addition, a plurality of spark discharges in one explosion step always ensures reliable and smooth ignition for the fuel in the cylinder even when one or several shots among a series of pulses or electric sparks should fail to occur, because other shots of them can provide sufficient ignition chances for the fuel. This will again improve the complete combustion of the fuel thereby improving the engine power and reducing the noxious components in the exhaust gases.

As stated above, according to this invention, since discharging current at high voltage is generated and distributed by the electric or electronic circuitry without using mechanically operated components as in the prior art system, engine misfire caused by the malfunction of such mechanical components under high rotation of the engine can be eliminated completely to thereby prevent the loss of engine power.

Further, since a desired number of electric spark discharges can be repeated per one explosion step even at the maximum engine rotation state in this invention by the use of electric pulses at a desired pulse rate, ignition can propagate at a greater speed throughout the fuel in the cylinder to thereby enhance the explosion force and, thus, increase the engine power, as well as avoid the generation of toxic substances in the exhaust gases due to incomplete combustion of the fuel.

Furthermore, since a plurality of spark discharges are produced, smooth and reliable ignition can always be obtained irrespective of the absence of one or several spark shots.

Furthermore, according to the modified embodiment of this invention, since the advance control for the ignition is carried out by the centrifugal movement of the movable feed arm of the distributor, ignition timing can be controlled automatically in a simple mechanism in accordance with the rotational speed of the engine.

What is claimed is:

1. An apparatus for igniting an internal combustion engine having a source of electric power, comprising:

a pulse generator connected to said power source for generating a train of pulses at such a desired pulse rate as capable of producing a desired number of electric discharges per one explosion step in each of engine cylinders at the maximum number of rotations of an engine crank shaft, a pulse transformer for stepping-up the voltage of said pulses so as to enable electric discharges of said pulses in a distributor and in ignition plugs, a distributor having an insulation tube securely disposed radially to a rotor means interlocked with the rotation of the engine, a feed arm disposed in said insulation tube with the discharging top end of the arm being situated inside the radial outermost end of said insulation tube and the base end of the arm being connected to the secondary windings of said pulse transformer and a plurality of stationary electrodes equal in number corresponding to that of the cylinders of the engine and arranged circumferentially at equally spaced intervals separated from each other by an insulating section along an outer circle concentric with a circle traced by the rotation of the outermost end of said insulation tube, and ignition plugs each disposed in each of said cylinders and connected to a different one of the stationary electrodes of said distributor, and wherein electric discharges of pulses are produced from the ignition plug in each of said cylinders by the number corresponding to the pulse rate of said pulses generated from said pulse generator at the optimum explosion timing when the evaporated fuels in each of the cylinders are compressed to the highest pressure.

2. An apparatus for igniting an internal combjstion engine, comprising:

a power source, a pulse generator connected to said power source for generating a train of pulses at such a desired pulse rate as capable of producing a desired number of electric discharges per one explosion step in each of engine cylinders at the maximum number of rotations of an engine crank shaft, a pulse transformer for stepping-up the voltage of said pulses so as to enable electric discharges of said pulses in a distributor and in ignition plugs, a distributor having an insulation tube securely disposed radially to a rotor means interlocked with the rotation of the engine, a feed arm disposed in said insulation tube with the discharging top end of the arm being situated inside the radial outermost end of said insulation tube and the base end of the arm being connected to the secondary windings of said pulse transformer and a plurality of stationary electrodes equal in number corresponding to that of the cylinders of the engine and arranged circumferentially at equally spaced intervals separated from each other by an insulating section along an outer circle concentric with a circle traced by the rotation of the outermost end of said insulation tube, ignition plugs each disposed in each of said cylinders and connected to a different one of the stationary electrodes of said distributor, wherein electric discharges of pulses are produced from the ignition plug in each of said cylinders by the number corresponding to the pulse rate of said pulses generated from said pulse generator at the optimum explosion timing when the evaporated fuels in each of the cylinders are compressed to the highest pressure, and wherein an advance control device for the ignition is provided to the distributor of the engine ignition apparatus, said advance control device being of a centrifugal type, in which the feed arm disposed within the insulation tube secured radially to the rotor means interlocking with the rotation of the engine crank shaft is made movable centrifugally in said tube in the radial direction of rotation in accordance with the rotation of said engine crank shaft.

3. In an ignition apparatus for an internal combustion engine having a plurality of cylinders, wherein a pulse generating means provides pulses through a distributor means to a corresponding plurality of ignition plugs, each of which has a stationary electrode, and wherein the distributor means includes a rotor means synchronized with the engine rotation, the improvement which comprises an insulation tube in the rotor means, the tube having an outer end with an opening therein, and a feed arm disposed in the tube and having a discharge end retracted inwardly from the opening in the tube, whereby an electric discharge is generated between the discharge end of the feed arm and the stationary electrode of a respective ignition plug when the feed arm and plug are disposed substantially opposite to each other, thereby assuring an effective electric discharge at the optimum point for explosion in the respective cylinder of the engine without the necessity for a contact breaker or other pulse triggering device.

4. In an ignition apparatus for an internal combustion engine having a plurality of cylinders, wherein a pulse generating means provides pulses through a distributor means to a corresponding plurality of ignition plugs, each of which has a stationary electrode, and wherein the distributor means includes a rotor means synchronized with the engine rotation, the improvement which comprises an insulation member in the rotor means, and a current feed member movable centrifugally within the insulation member in accordance with the engine rotational speed, thereby varying the angle of the electric discharge from the feed member to the respective opposing stationary electrode, and thereby providing advance control for the ignition.

5. The apparatus as defined in claim 1, wherein an advance control device for the ignition is provided to the distributor of the engine ignition apparatus.

6. The improvement of claim 3, wherein the feed arm is movable centrifugally within the insulation tube in accordance with the engine rotational speed.

* * * * *